US008366589B2

(12) United States Patent
Tyree

(10) Patent No.: US 8,366,589 B2
(45) Date of Patent: Feb. 5, 2013

(54) EXERCISE EQUIPMENT

(76) Inventor: Timothy Tyree, Scottsdale, AZ (US)

( * ) Notice: Subject to any disclaimer, the term of this patent is extended or adjusted under 35 U.S.C. 154(b) by 147 days.

(21) Appl. No.: 12/930,212

(22) Filed: Dec. 30, 2010

(65) Prior Publication Data

US 2012/0172183 A1 Jul. 5, 2012

(51) Int. Cl.
*A63B 21/00* (2006.01)

(52) U.S. Cl. ..... 482/19; 482/14; 482/902

(58) Field of Classification Search ..... 482/19, 482/8, 901, 14; 73/379.1, 865.4 X
See application file for complete search history.

(56) References Cited

U.S. PATENT DOCUMENTS 2,978,692 A * 4/1961 Riley ..... 340/323 R
4,611,803 A * 9/1986 Newton, Jr. ..... 482/19
4,956,628 A * 9/1990 Furlong ..... 340/323 R

* cited by examiner

*Primary Examiner* — Jerome W Donnelly
(74) *Attorney, Agent, or Firm* — Tod R. Nissle, P.C.

(57) ABSTRACT

Exercise equipment is adaptable to a variety of resistance and acceleration configurations which are used improve an individual's start in the forty yard dash, and to improve an individual's performance in a variety of other exercises.

1 Claim, 14 Drawing Sheets

EXERCISE EQUIPMENT

This invention relates in general to workout or exercise equipment, and in particular to such equipment which can be assembled in a variety of configurations to pursue particular exercise programs.

In many cases, the time that an athlete posts in running a forty yard sprint is important in determining whether the athlete will receive a college athletic scholarship or will advance to the next competitive level. A forty yard sprint includes the start (from a stationary position), the middle portion of the sprint, and the finish. It is the start that causes most athletes to record a poor time in the forty yard sprint.

Accordingly, it would be highly desirable to provide exercise equipment which facilitates the improvement of start times in the forty yard dash, and which also facilitates a variety of other exercises.

Therefore, it is a principal object of the present invention to provide improved exercise equipment.

Another object of the invention is to provide an improved exercise regime to reduce the start time of an athlete who performs a forty yard dash.

These and other, further and more specific objects of the invention will be apparent to those of skill in the when taken in conjunction with the following description and the drawings, in which.

Briefly, in accordance with the invention, I provide improved exercise equipment. The apparatus is utilized in a method to improve an individual's start time in the forty yard dash. The method comprises the step of providing the exercise equipment. The equipment includes a base; a control housing mounted in the base and including a resistance system attachable to the individual, and including an acceleration system attachable to the individual; first and second elongate leg structures; a belt shaped and dimensioned to be worn by the individual; at least first and second elongate resilient elastic members each including a first end attached to the belt, and including a second end attached to a different one of the elongate leg structures. The exercise equipment is configurable in at least three different configurations, a primary configuration with the control housing mounted in the base in the resistance configuration, a secondary configuration with the control housing mounted in the base in the acceleration configuration, and a tertiary configuration. In the tertiary configuration, the structures are spaced apart; the first end of the first elastic member is attached to the belt and the second end of the first elastic member is attached to the first leg structure to tension the first elastic member, the first end of the second elastic member is attached to the belt, and the second end of the second elastic member is attached to the second elongate leg structure to tension the second elastic member. The method also includes the steps of configuring the exercise equipment in the primary configuration; attaching the resistance system to the individual for the individual to perform a resistance exercise; detaching the resistance system from the individual; configuring the exercise equipment in the secondary configuration; attaching the acceleration system to the individual for the individual to perform an acceleration exercise; detaching the acceleration system from the individual; configuring the exercise equipment in the tertiary configuration; and, mounting the belt on the individual to perform an exercise selected from one of a group consisting of a resistance exercise and an acceleration exercise.

Figure 1:
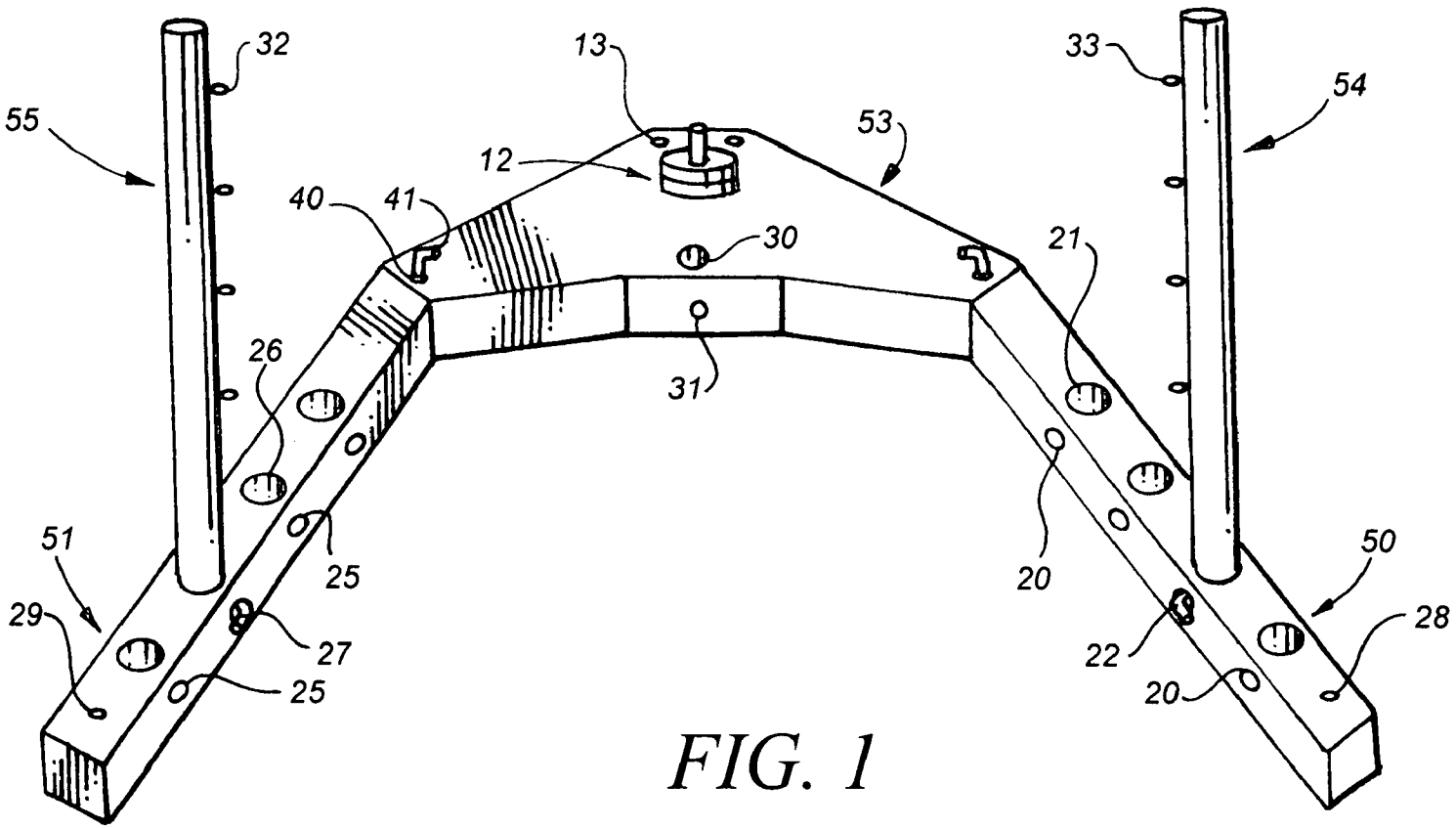
FIG. 1 is a perspective view illustrating exercise equipment constructed in a first configuration in accordance with the invention.
Figure 2:
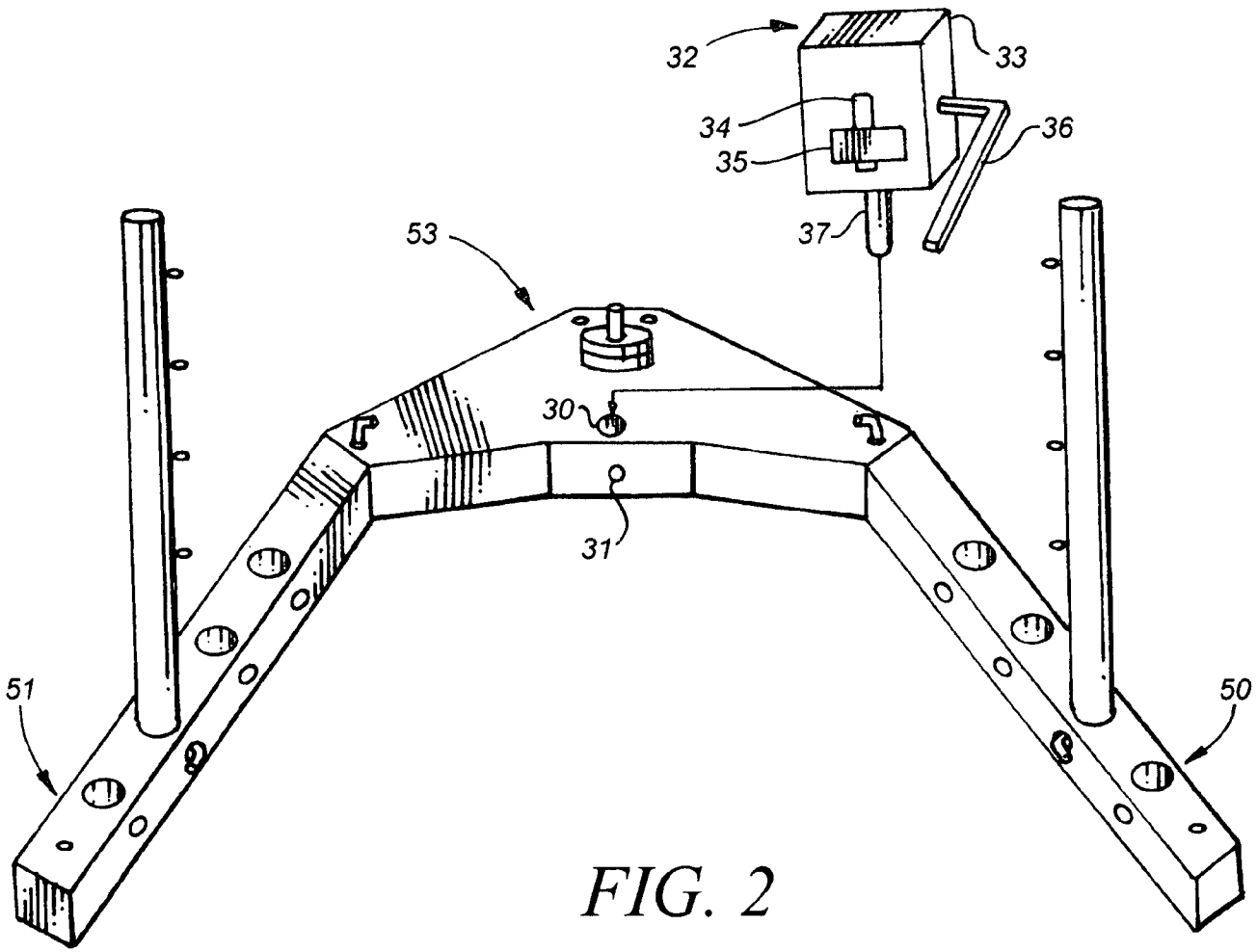
FIG. 2 is a perspective view illustrating exercise equipment constructed in a second configuration in accordance with the invention.

Turning now to the drawings, in which like reference characters refer to corresponding elements throughout the several views and which present the invention by way of illustration and not limitation, FIGS. 1 and 2 illustrate exercise equipment constructed in accordance with the principles of the invention and including base 53, control unit 32, first elongate leg structure 50, and second elongate leg structure 51. The equipment also includes a belt 69 (FIG. 6) worn by an individual 70A that is using the equipment when the equipment is in certain configurations; includes at least a pair of elongate elastic resilient bands 47 and 48 (FIG. 6); includes weights 12 (FIG. 1); includes at least a pair of standards 54 and 55 each with a plurality of spaced apart eyelets or hooks 32; includes apertures 21 and 26 formed in leg structures 50 and 51, respectively, each to slidably removably receive the proximate or lower end of one of standards 54 and 55; includes apertures 20 and 25 formed in leg structures 50 and 51, respectively, to receive quick release pins 22 and 27, respectively, which pins each removably extend through an aperture 20 or 25 and into an opening (not visible) that is formed in the proximate end of standard 54 or 55; includes aperture 30 formed in base 53 to slidably receive foot 37 (FIG. 2) of control unit 32; includes aperture 31 formed in base 53 to receive slidably and removably a quick release pin (not shown) which extends through aperture 31 and into an opening (not shown) formed in the lower end of foot 37 to secure removably foot 37 in aperture 30; and includes pegs 41 which extend through apertures 28, 29, 40 to secure base 53 and leg structures 50 and 51 in a desired location on an outdoors field or other desired area. Quick release pins 22, 27 secure standards 54 and 55 in leg structures 50 and 51, respectively. While pegs 41 can be shaped and dimensioned to secure base 53 and legs 50 and 51 to the floor in a building structure, pegs 41 presently preferably are each configured to be pounded into the earth in a field or other out-of-doors area. The exercise equipment is preferably intended to be used on a football field, baseball field, or other out-of-doors area.

The exercise equipment can also include an elongate resilient elastic band 49 with a pliable fabric support 52 connected to the strap. The ends of each band 38 (FIG. 3), 47, 48, 49, 67, 68 (FIG. 6), 78, 79 (FIG. 8), 80, 81 (FIG. 9), 84, 85 (FIG. 10), 87, 88 (FIG. 11), 89, 90 (FIG. 12), 91, 92 (FIG. 13), 93 and 94 (FIG. 14) are each looped or otherwise shaped and dimensioned to secure the end to an eyelet 32, 33, to a belt 39 (FIG. 3), to a belt 69 (FIG. 6), or to another component of the exercise equipment.

Figure 3:
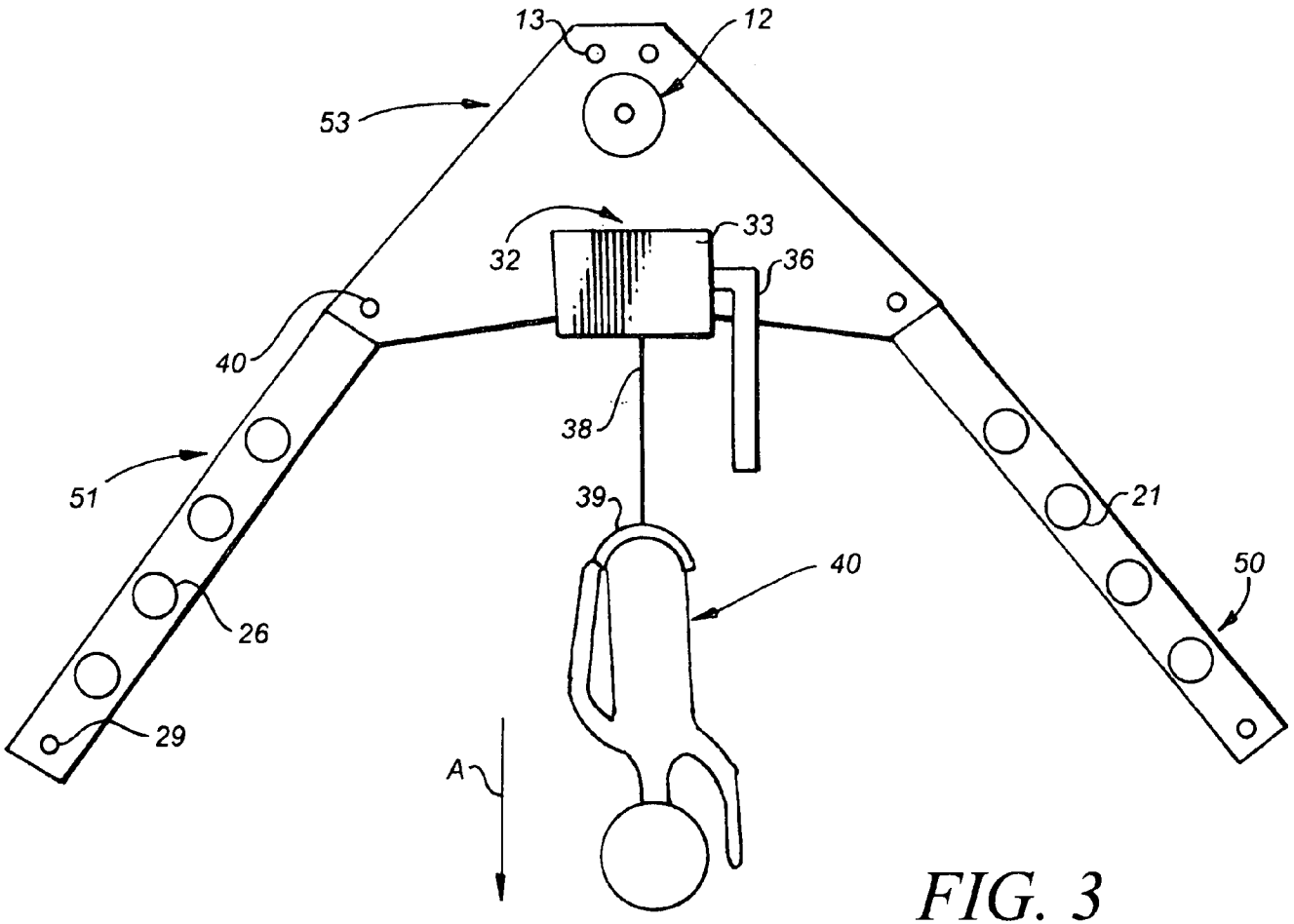
FIG. 3 is a top view illustrating the exercise equipment of FIG. 2 further configured for an athlete to perform an exercise to improve the athlete's start time in the forty yard dash.
Figure 4:
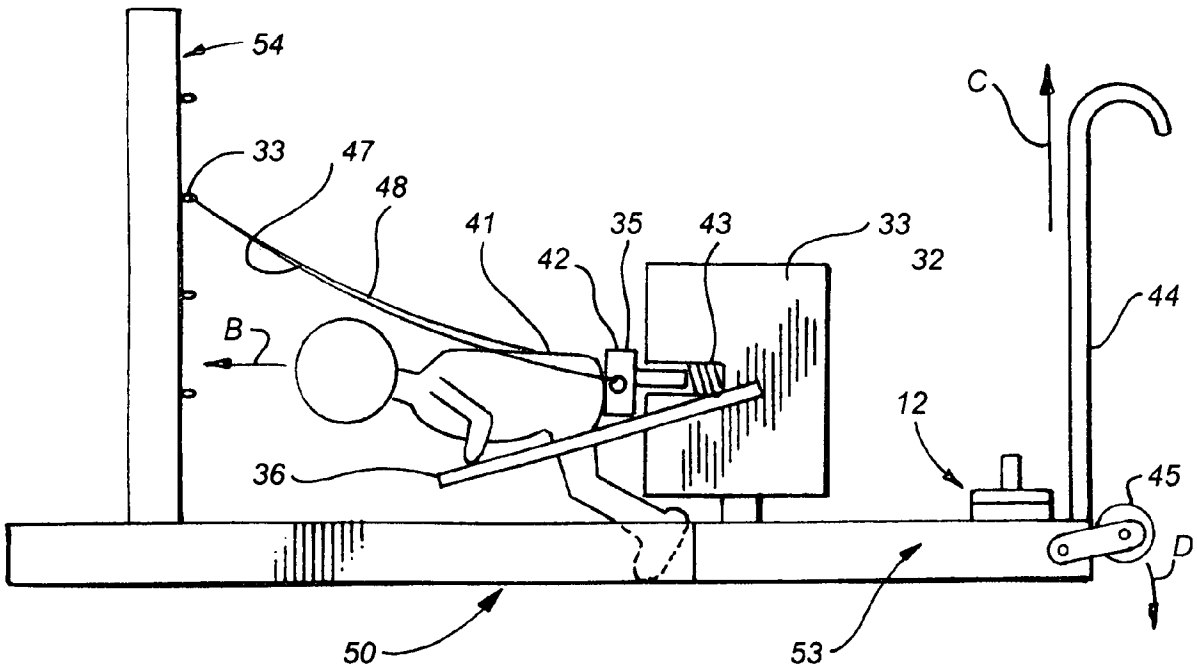
FIG. 4 is a side view illustrating the mode of operation of the exercise equipment of FIG. 2 for an athlete to perform an exercise to improve the athlete's start time in the forty yard dash.

The function and additional features of control unit 32 are evident in FIGS. 2 to 4. Control unit 32 includes housing 33, slot 34 formed in housing 33, acceleration platform 35, and lever 36. The position of platform 35 is slidably vertically adjustable by indexing platform 35 upwardly and downwardly in slot 34. In FIG. 4, a pad 42 is releasably attached to platform 35 with, for example, small amounts of VELCO. Bands 47 and 48 are depicted in FIG. 4 as being slack but instead are preferably tensioned. Platform 35 is spring loaded in housing 33 such that when level arm 36 is downwardly depressed toward the ground by an individual using the apparatus, compressed spring 43 is released and pushes platform 35 a short distance in the direction of arrow B. This "launches" or accelerates the individual 41 in the direction of arrow B. As the individual begins to run in the direction of arrow B, tensioned bands 47 and 48 pull pad 42 free of platform 35 and continue to provide an acceleration force that helps to move individual 41 in the direction of arrow B. If desired, tensioned bands 47 and 48 need not be attached to pad 42 but can instead be attached to a belt 69 worn by the individual.

In FIG. 3, one end of elastic band 38 is attached to housing 33 while the other end of band 38 is attached to a belt 39 worn around the lower waist of an individual. Band 38 resists the movement of individual 40 in the direction of arrow A.

In FIG. 4, one or more wheels 45 are attached to base 45 and leg structures 50 and 51. In FIG. 4, wheel 45 is depicted in a stowed position. When wheel 45 is deployed, it rotates downwardly in the direction of arrow D to contact the ground, and, it upwardly displaces the bottom of base 53 off the ground in the direction of arrow C and facilitates, by pushing or pulling the apparatus so the wheel rolls over the ground, transport of the exercise apparatus to a desired location. A handle 44 attached to base 53 can also be utilized to lift base 53 in the direction of arrow C.

Figure 6:
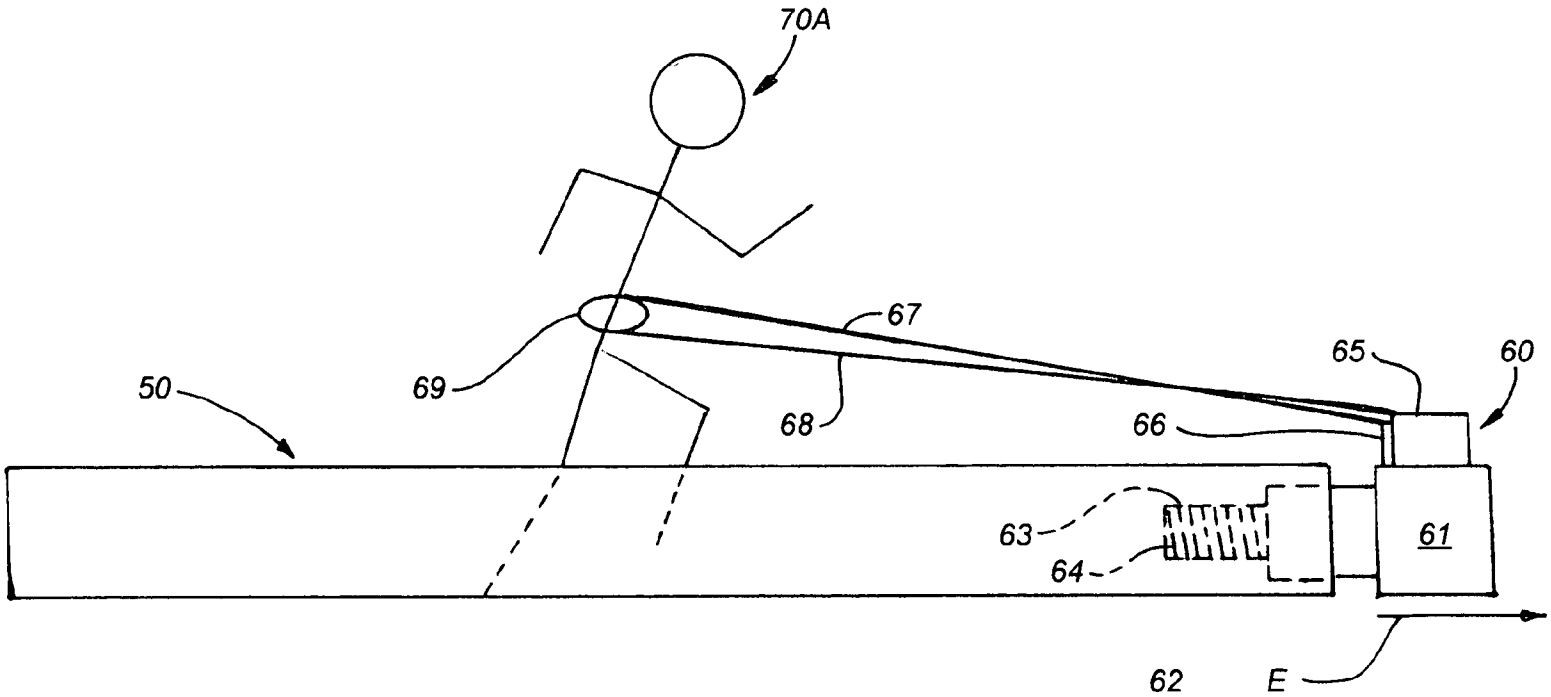
FIG. 6 is a side view illustrating exercise equipment of the invention constructed in a third configuration in accordance with the invention for an athlete to perform an exercise to improve the athlete's start time in the forty yard dash.
Figure 11:
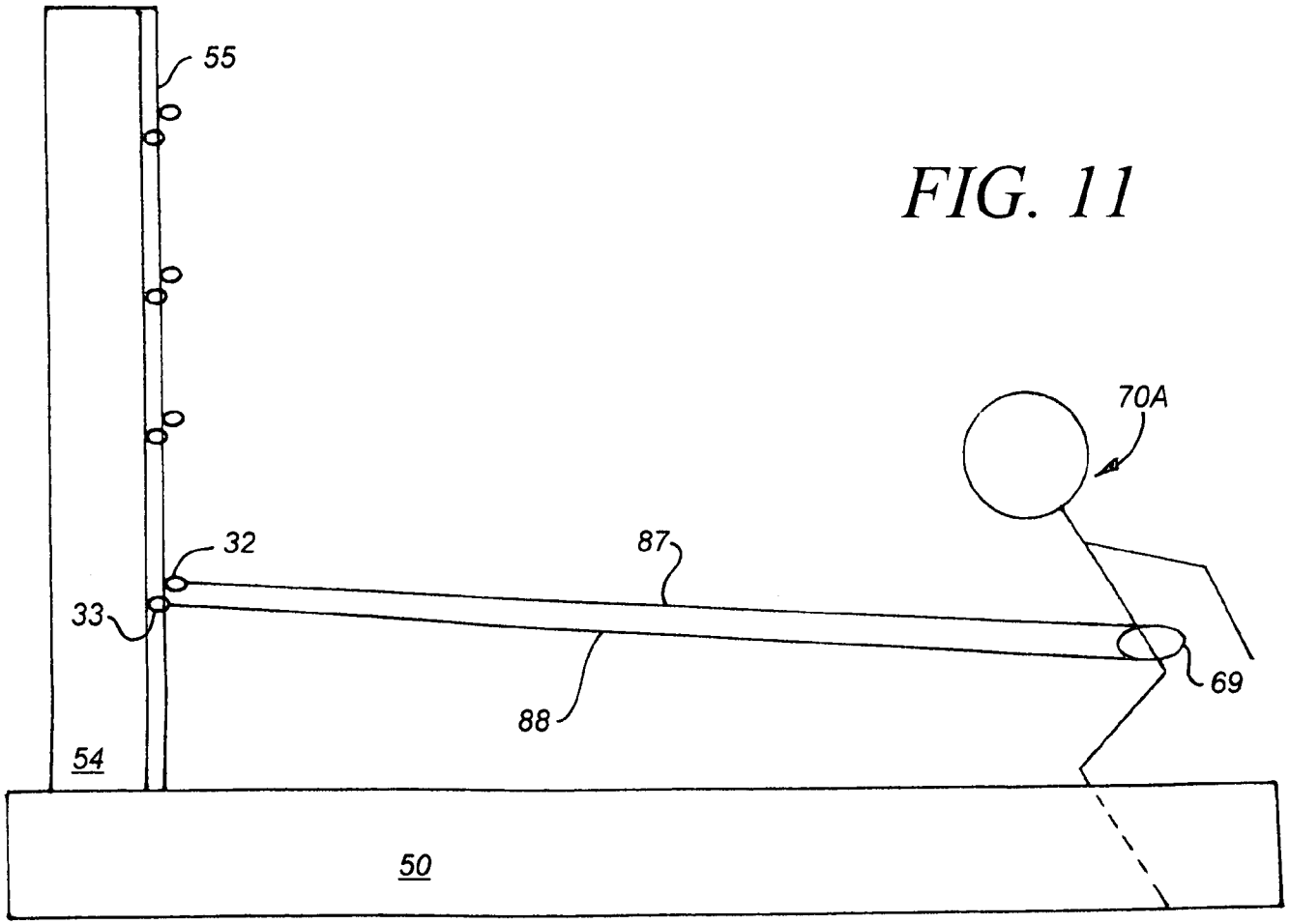
FIG. 11 is a side view illustrating exercise equipment of the invention constructed in a seventh configuration to improve an athlete's performance in a jumping exercise.
Figure 12:
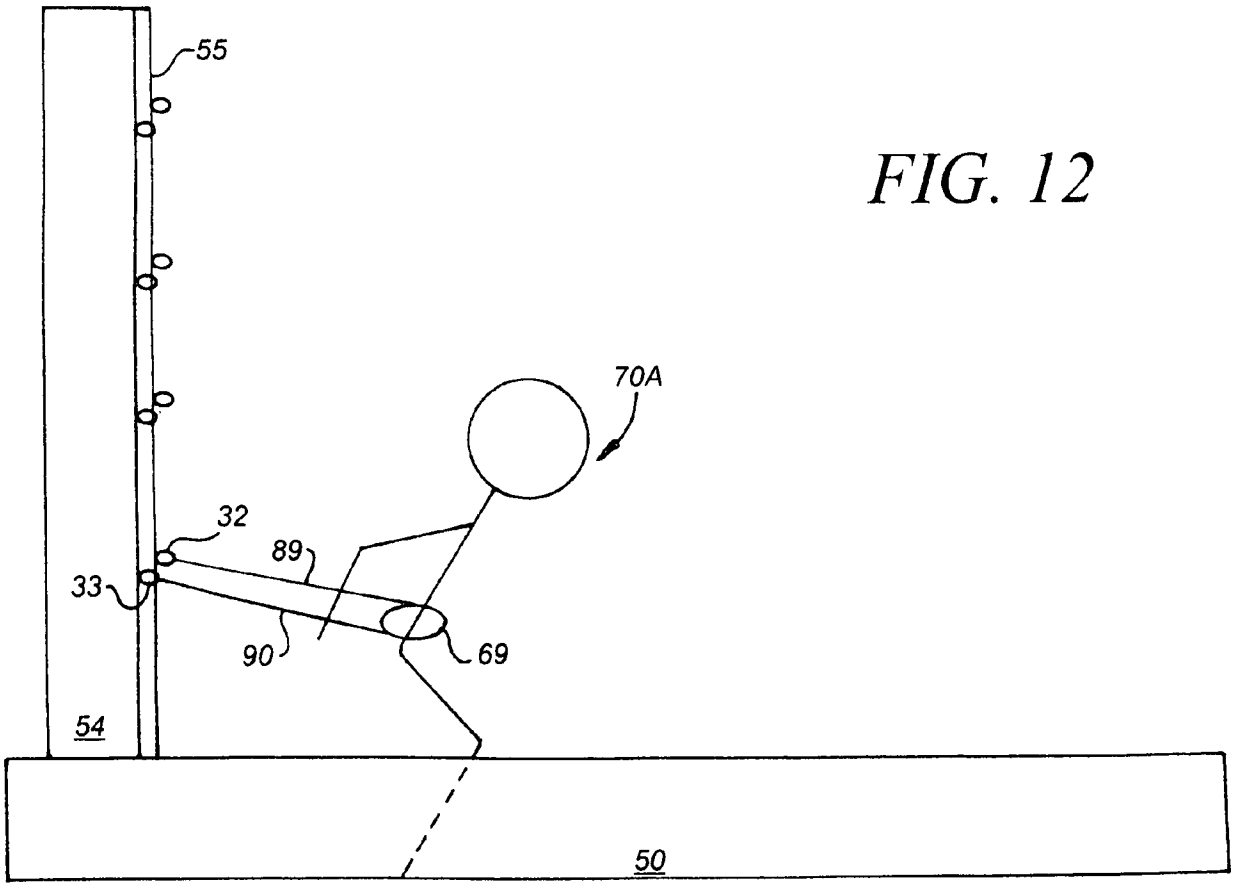
FIG. 12 is a side view illustrating exercise equipment of the invention constructed in an eighth configuration to improve an athlete's performance in a jumping exercise.
Figure 13:
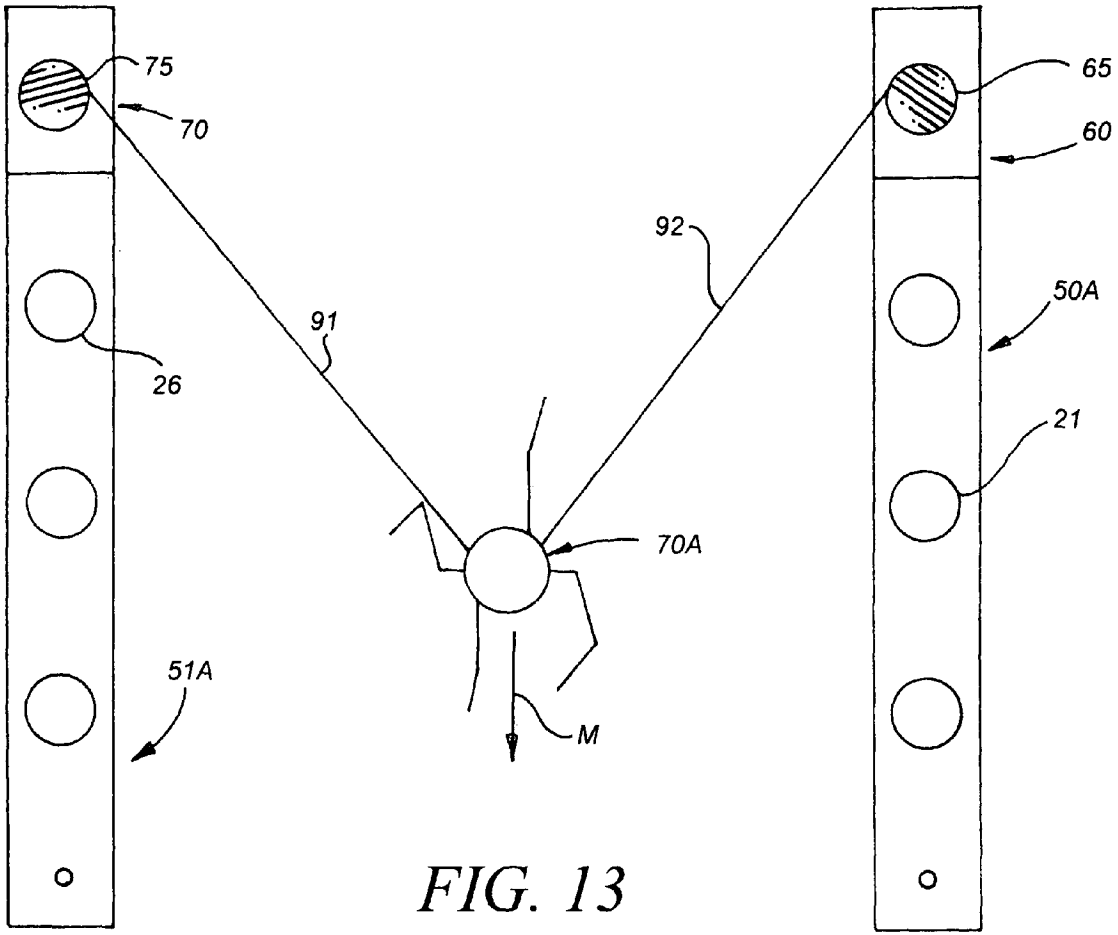
FIG. 13 is a top view illustrating exercise equipment of the invention constructed in a ninth configuration to improve an athlete's performance in a running exercise; and, FIG. 14 is a top view illustrating exercise equipment of the invention constructed in a tenth configuration to improve an athlete's performance in a running exercise.
Figure 14:
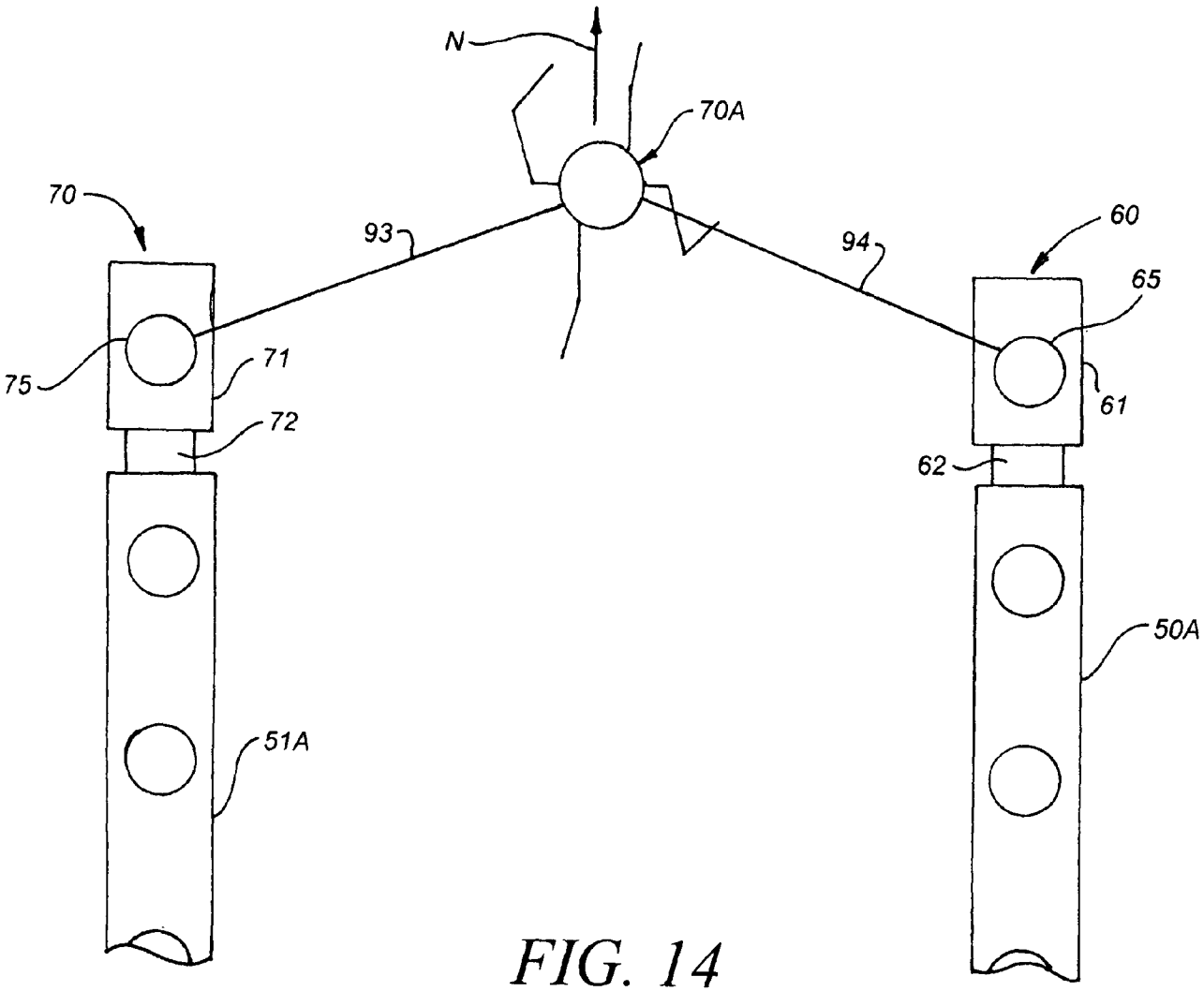

In FIGS. 6 to 12, leg structures 50 and 51 are detached from base 53 and are arranged in a spaced apart parallel configuration comparable to that illustrated for leg structures 50A and 51A in FIGS. 13 and 14. In FIGS. 6 to 8 and 13 and 14, one end of each leg structure 50, 50A, 51, 51A is provided with a spring loaded slide component 60 or 70. Leg structures 50 and 50A are each provided with a slide component 70. Leg structures 51 and 51A are each provided with a slide component 60. Slide component 60 is equivalent in shape, dimension and function to slide component 70. Slide component 60 includes base 61, tower 65 attached to and upwardly projecting from base 61, slide 62, and spring 64 housed in opening 63 formed in one end of leg structure 50. Slide 62 is slidably received by an opening formed in leg structure 50. In FIG. 6, when a runner approaches component 60 and 70, the tension in bands 67 and 68 lessens. When the tension is reduced a sufficient amount, spring 54 displaces slide 62 (and consequently base 61 and tower 65) in the direction of arrow E to maintain some tension in bands 67 and 68. Spring 64 is sufficiently strong to maintain tension in bands 67 and 68 while slide 62 travels in the direction of arrow. When, of course, slide 62 reaches the end of its travel, bands 67 and 68 will eventually become slack as the individual 70A continues to move toward slide component 60. In contrast, when individual 70A runs away from slide component 60 (and 70) in the direction of arrow F in FIG. 7, the tension in bands 67 and 68 increases and eventually is sufficient to overcome spring 64, to cause spring 64 to compress, and to slide component 60 in the direction of arrow F. When component 60 slides in the direction of arrow E, the buildup of the magnitude of the resistance forces provided by elastic bands 67 and 68 is increased because of resistance the spring 43 generates as the spring 43 is compressed. Once base 61 contacts the end 50E of leg structure 50, the movement of base 61 in the direction of arrow F is halted. As the individual starts or runs in the direction of arrow F, bands 67 and 68 elongate and the resistance provided by bands 67 and 68 increases. Slide component 70 includes base 71, tower 75, and slide 72 (FIG. 14). The spring associated with component 70 is not visible in FIGS. 13 and 14. Leg structure 50A is substantially equivalent to leg structure 50 except that fewer apertures 21 are formed in leg structure 50A. Leg structure 51A is substantially equivalent to leg structure 51 except that fewer apertures 26 are formed in leg structure 51A.

Figure 9:
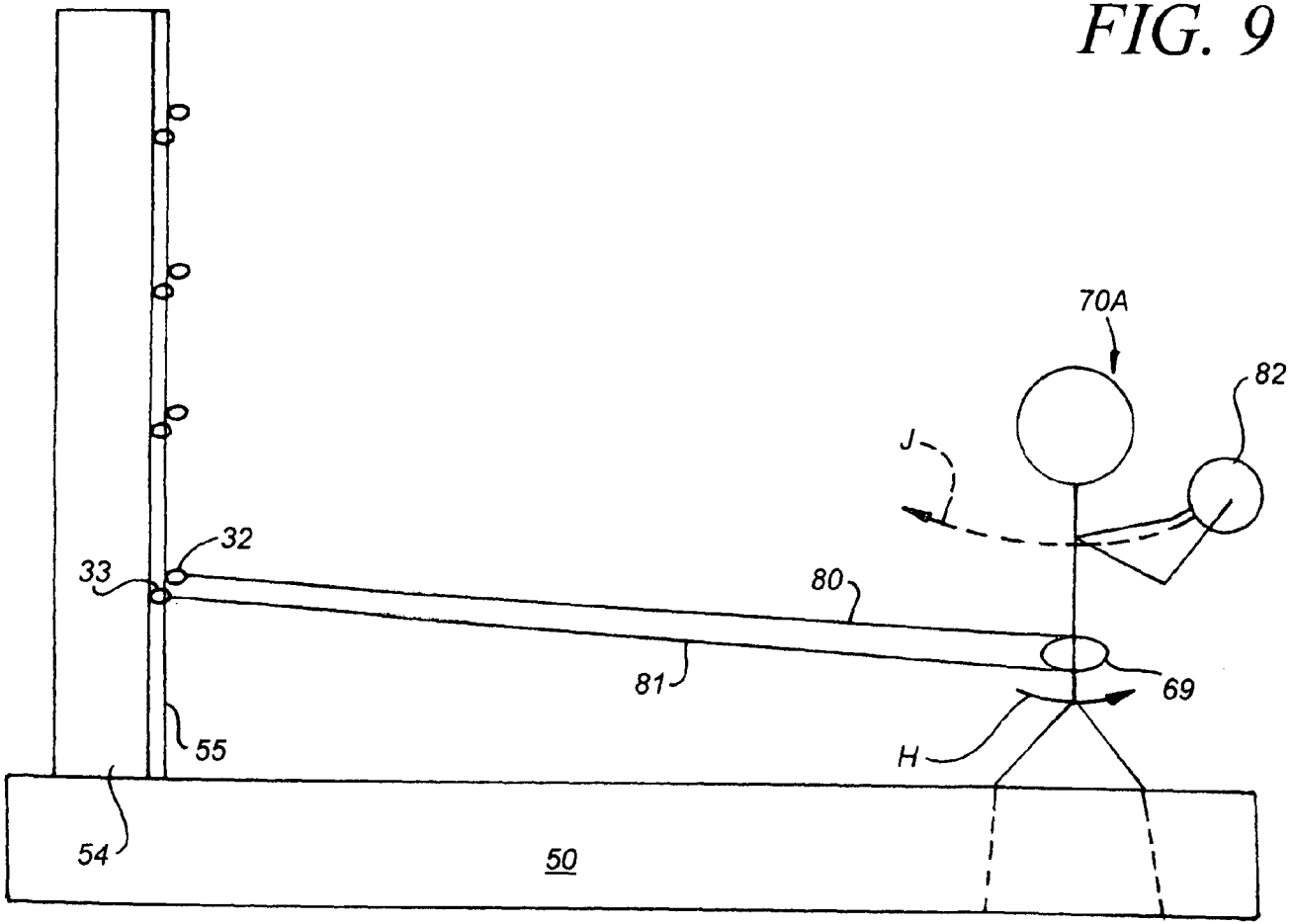
FIG. 9 is a side view illustrating exercise equipment of the invention constructed in a fifth configuration to improve an athlete's performance in a ball toss exercise.
Figure 10A:
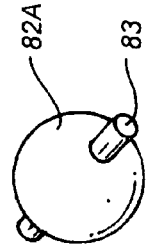
FIG. 10 is a side view illustrating exercise equipment of the invention constructed in a sixth configuration to improve an athlete's performance in a ball toss exercise.
Figure 10:
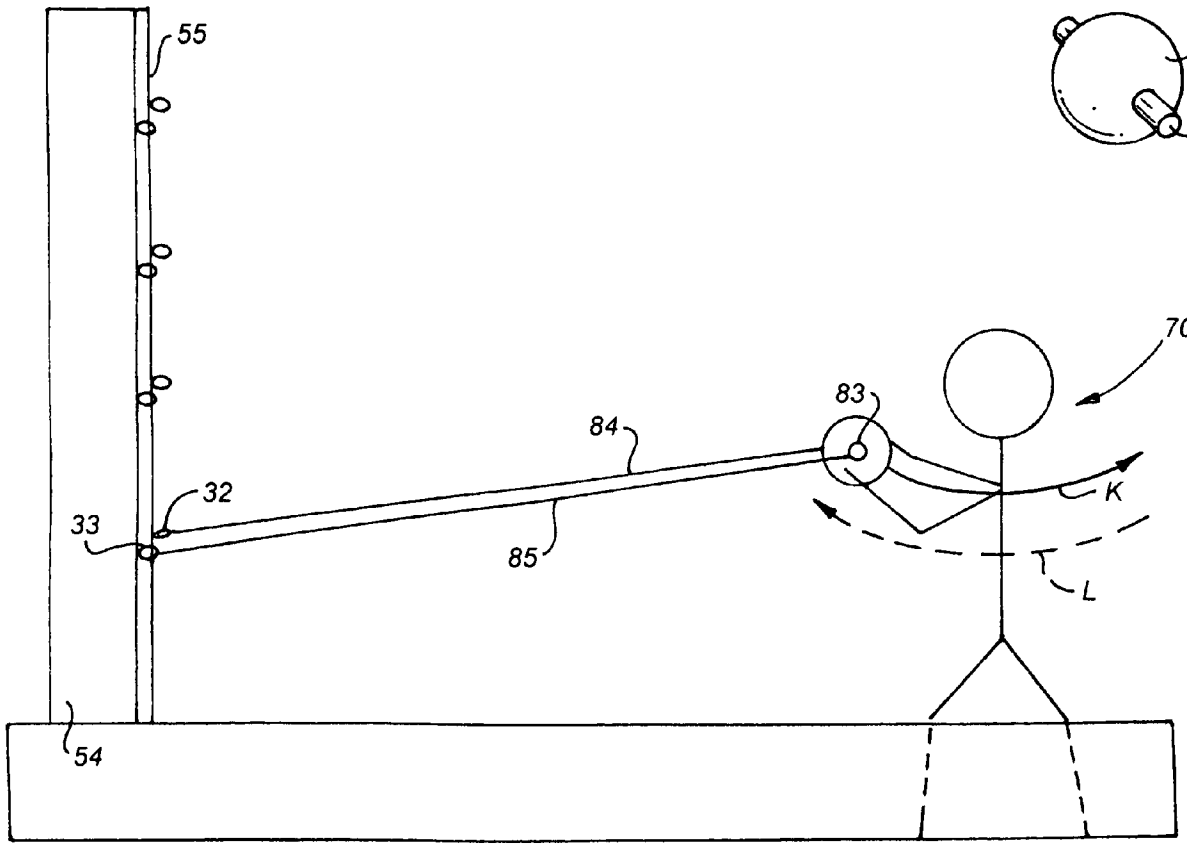

In FIG. 9, the exercise equipment of the invention includes a ball 82. In FIG. 10, the exercise equipment of the invention also comprises a ball 82A, but with a rod 83 extending through and fixedly mounted in the ball 82A.

The drawings illustrate the exercise equipment of the invention in a variety of configurations.

The configuration of FIG. 3 is a resistance configuration. When an individual attempts to start or run in the direction of arrow A, elastic band 38 produces a force which acts in the opposite direction and resists movement of the individual in the direction of arrow A.

The configuration of FIG. 4 is an acceleration configuration. When an individual simultaneously starts in the direction of arrow B and depresses lever 36 downwardly toward the ground, spring 43 is permitted to expand and displace panel 35 in the direction of arrow B to push against the individual's bottom and facilitate the individual's acceleration in the direction of arrow B. Similarly, tensioned bands 47 and 48 pull pad 42 (or a belt 69 that is worn by the individual and attached to the ends of bands 47 and 48) in the direction of arrow B to provide a force component that pushes the individual in the direction of arrow B.

Figure 5:
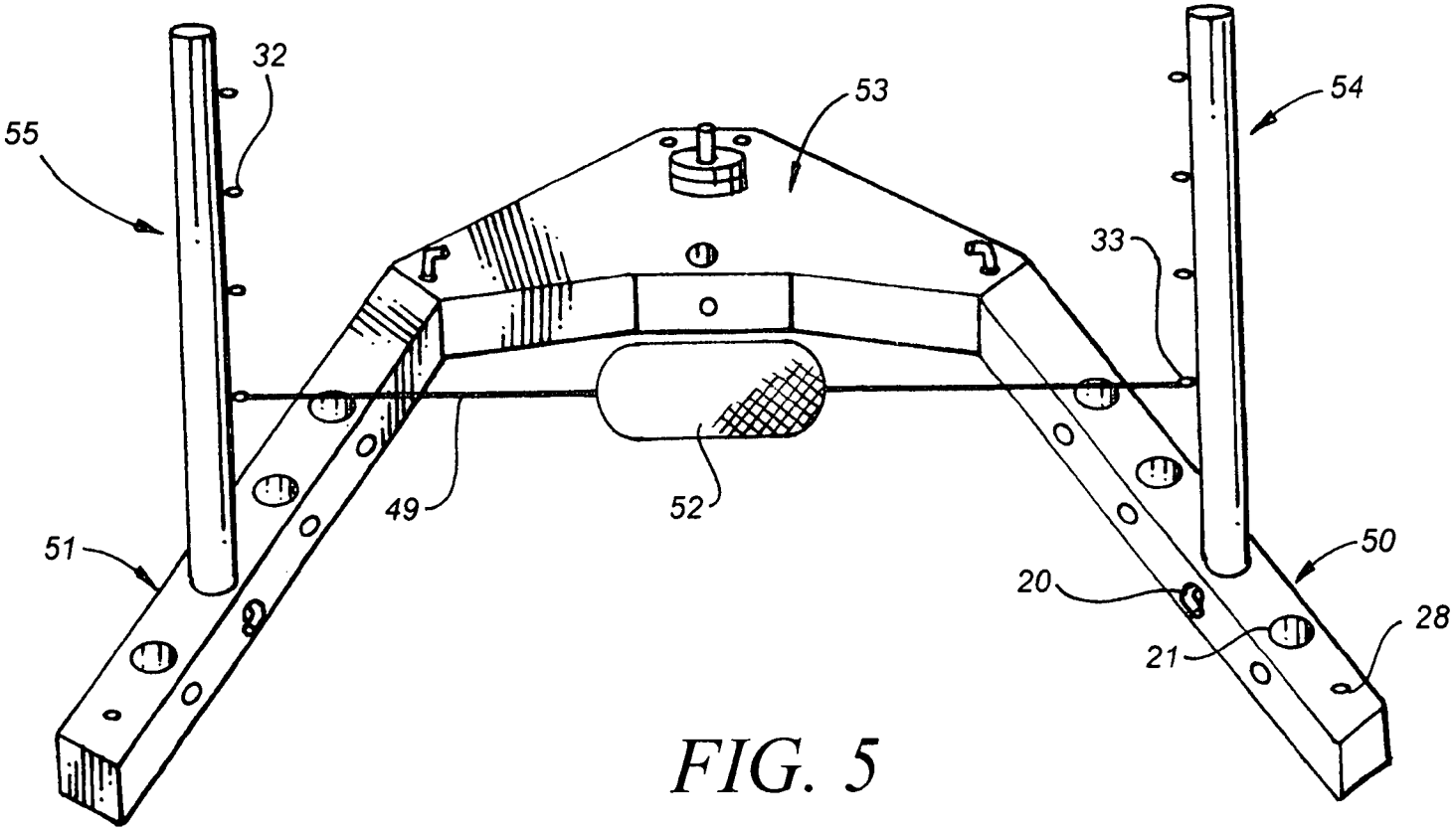
FIG. 5 is a perspective view illustrating the exercise equipment of FIG. 1 further configured for an athlete to perform an exercise to improve an athlete's start time in the forty yard dash.

The configuration of FIG. 5 is an acceleration configuration. In use, an individual backs his derriere into pliable fabric member 52 to displace member 52 a selected distance toward base 53. This further tensions band 49. The individual then, with the band still further tensioned, assumes a starting position. When the individual starts running, band 49 produces a force which helps accelerate the individual away from base 53.

The configuration of FIG. 6 is an acceleration configuration. Tensioned bands 67 and 68 produce a force which acts in the direction of arrow E and helps to accelerate the individual's movement in the direction of arrow E. In use of the configuration of FIG. 6, it is preferred that individual 70A (while wearing belt 69 with bands 67 and 68 attached) back away from slide components 60 and 70 (while facing components 60 and 70) to tension bands 67 and 68, assume a stationary starting position, and then begin to run in the direction of arrow E. Tensioned bands 67 and 68 then function to pull and accelerate individual 70A in the direction of arrow E. As would be appreciated by those of skill in the art, belt 69 is shaped to fit snugly about the waist of individual 70A so that belt 69 is not pulled off individual 70A by tensioned bands 67 and 68. The ends of bands 67, 68 attached to belt 69 can each be attached to an eyelet or rings which remains at a fixed location on belt 69, or, can each be attached to a ring which freely slides along belt 69.

Figure 7:
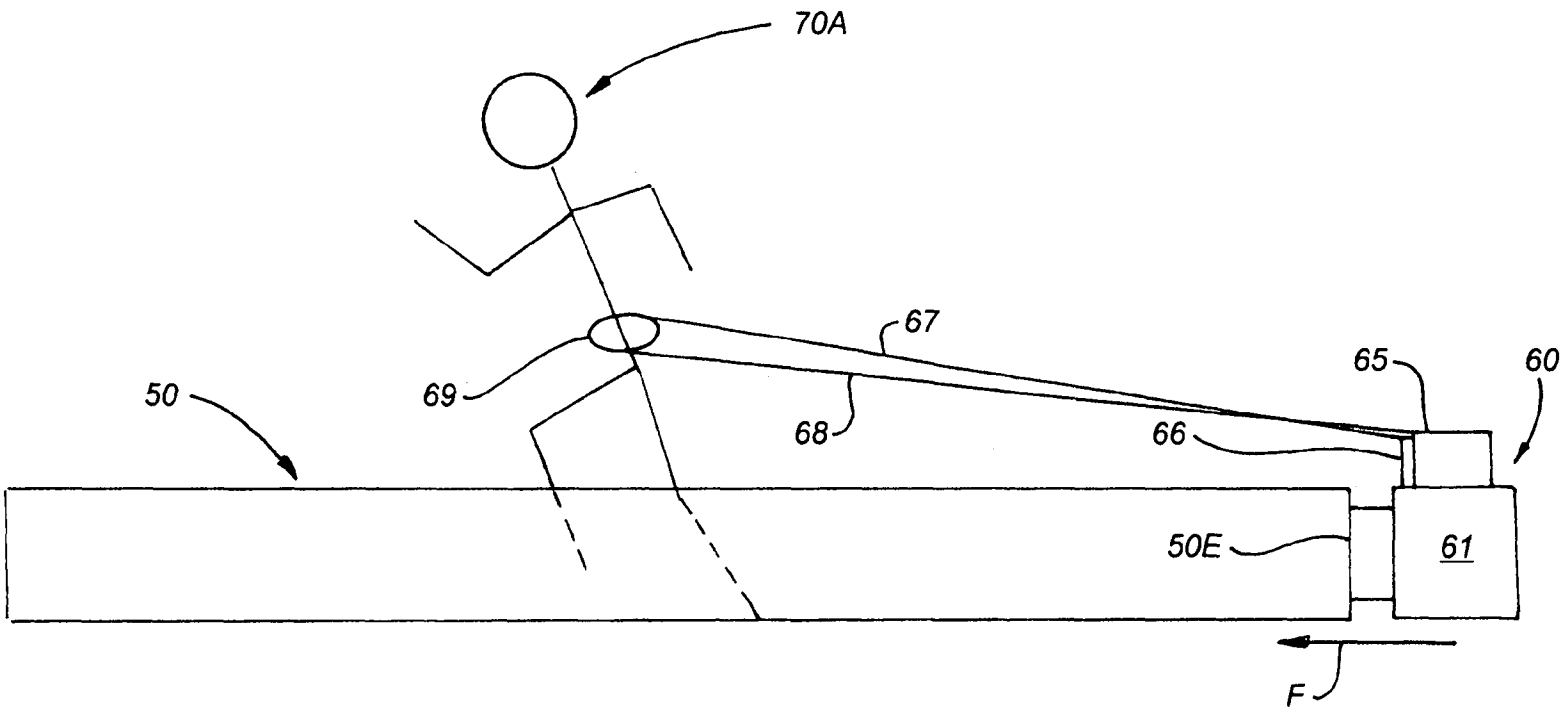
FIG. 7 is a side view of the exercise equipment of FIG. 6 illustrating the mode of operation thereof for an athlete to perform an exercise to improve the athlete's start time in the forty yard dash.

The configuration of FIG. 7 is a resistance configuration. Tensioned bands 67 and 68 produce a force which acts in a direction opposite that of arrow F. In use of the configuration of FIG. 7, it is preferred that individual 70A (while wearing belt 69 with bands 67 and 68 attached) face away from slide components 60 and 70, walk in the direction of arrow F a distance away from components 60 and 70 sufficient to tension bands 67 and 68, assume a stationary starting position, and then begin to run in the direction of arrow F. Tensioned bands 67 and 68 then function to pull and resist movement of individual 70A in the direction of arrow F.

Figure 8:
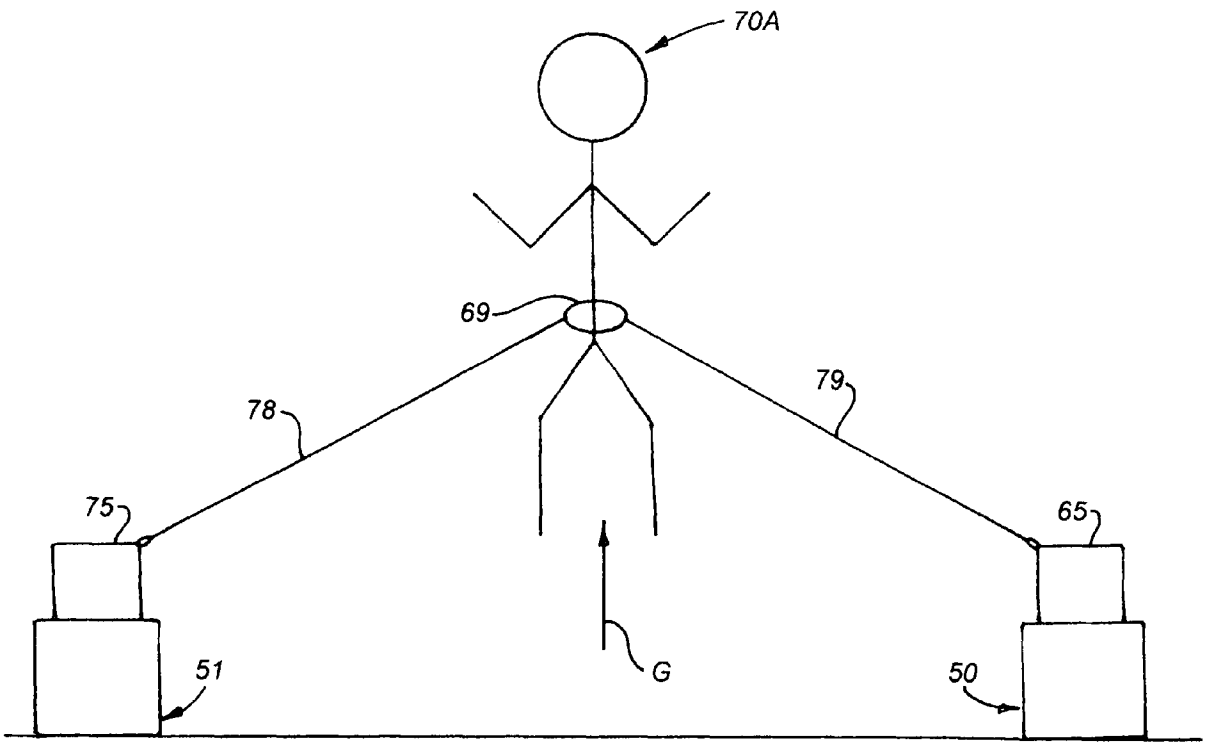
FIG. 8 is an end view illustrating exercise equipment of the invention constructed in a fourth configuration to improve an athlete's performance in a vertical leap exercise.

The configuration of FIG. 8 is a resistance configuration. When an individual 70A (while wearing belt 69 with bands 67 and 68 attached) stands intermediate leg structures 50 and 51 and jumps upwardly in the direction of arrow G, tensioned bands 78 and 79 function to pull and resist movement of individual 70A in the direction of arrow G.

The configuration of FIG. 9 can function as either a resistance configuration or an acceleration configuration. When an individual throws a ball 82 in the direction of arrow J, the individual's body tends to move forward in the direction of arrow J toward standards 54 and 55. In that case, tensioned bands 80 and 81 function to pull and accelerate the individual's body toward standards 54 and 55. On the other hand, when the individual "winds up" and moves the ball 82 to the position depicted in FIG. 9, the individual may tend to move his body away from standards 54 and 55, in which case bands 80 and 81 produce resistance to the movement of individual 70A.

The configuration of FIG. 10 also functions both as a resistance configuration and an acceleration configuration. When the individual grasps ball 82A and "winds up" by moving the ball in the direction of arrow K, tensioned bands 84 and 85 resist the movement of the ball. When the individual 70A throws and releases the ball in the direction of arrow L, tensioned bands 84 and 85 assist the movement and acceleration of ball 82.

The configuration of FIG. 11 is an acceleration configuration. When the individual 70A jumps toward standards 54 and 55, tensioned bands 87 and 88 accelerate the movement of the individual toward standards 54 and 55.

The configuration of FIG. 12 is a resistance configuration. When the individual 70A jumps away from standards 54 and 55, tensioned bands 89 and 90 resist movement of the individual 70A away from standards 54 and 55.

The configuration of FIG. 13 is a resistance configuration. Tensioned bands 91 and 92 resist movement of the individual in the direction of arrow M.

The configuration of FIG. 14 is a resistance configuration. Tensioned bands 93 and 94 resist the movement of the individual 70A in the direction of arrow N.

In one preferred embodiment of the invention set forth in the EXAMPLE below, the exercise apparatus of the invention is configured specifically to train an individual to improve the start of the individual during the forty yard dash, sixty yard dash, 100 yard dash, etc.

EXAMPLE

The exercise apparatus is set up in the resistance configuration of FIG. 3 with the individual wearing a belt 39. The individual 40 moves a distance away from housing 33 sufficient to tension band 38, assumes a stationary starting position and then begins the forty yard dash by moving in the direction of arrow A. Tensioned band 38 resists movement of individual 40 in the direction of arrow A. This sequence is repeated at least once, after which belt 39 is removed from the individual.

The exercise apparatus is set up in the acceleration configuration of FIG. 4. The individual assumes a starting position with his derriere positioned against pad 42 and then simultaneously begins running in the direction of arrow B and depressing lever 36 downwardly toward the ground. Depressing lever 36 releases spring 43 which displaces pad 42 and panel 35 in the direction of arrow B to help accelerate the individual 41 in the direction of arrow B. This sequence of events is carried out at least once.

The exercise apparatus is set up in the resistance configuration of FIG. 7 The individual 70A puts on belt 69. Bands 67 and 68 extend between belt 69 and towers 66 and 65, respectively. The individual, while facing away from towers 65 and 66, moves away from towers 65 and 66 to tension bands 67 and 68, assumes a stationary starting position, and then begins to run in the direction of arrow F away from towers 65 and 66. Tensioned bands 67 and 68 resist the movement of the individual in the direction of arrow F. This sequence of events is carried out at least once.

The exercise apparatus is set up in the acceleration configuration of FIG. 6. The individual 70A puts on belt 69. Bands 67 and 68 extend between belt 69 and towers 66 and 65, respectively. The individual, while facing towers 65 and 66, moves away from towers 65 and 66 to tension bands 67 and 68, assumes a stationary starting position, and then begins to run in the direction of arrow E toward towers 65 and 66. Tensioned bands 67 and 68 assist the movement of the individual in the direction of arrow E. This sequence of events is carried out at least once.

Other acceleration and resistance configurations of the equipment of the invention can be utilized. The use of alternating resistance and acceleration configurations is believed to improve significantly an individual's start in the forty yard dash.

Having described the presently preferred embodiments and best mode of the invention in such terms as to enable those of skill in the art to understand and practice the invention, I claim:

1. A method of training to improve an individual's start time in the forty yard dash, comprising the steps of (a) providing exercise equipment including (i) a base, (ii) a control housing mounted in said base and including a resistance system attachable to the individual, and an acceleration system attachable to the individual, (iii) first and second elongate leg structures, (iv) a belt shaped and dimensioned to be worn by the individual, (v) at least first and second elongate resilient elastic members each including a first end attached to said belt, and a second end attached to a different one of said elongate leg structures, said exercise equipment configurable in at least three different configurations, (vi) a primary configuration with said control housing mounted in said base in said resistance configuration, (vii) a secondary configuration with said control housing mounted in said base in said acceleration configuration, (viii) a tertiary configuration with said leg structures spaced apart, said first end of said first elastic member attached to said belt and said second end of said first elastic member attached to said first leg structure to tension said first elastic member, said first end of said second elastic member attached to said belt and said second end of said second elastic member attached to said second elongate leg structure to tension said second elastic member;

(b) configuring said exercise equipment in said primary configuration;

(c) attaching said resistance system to the individual for the individual to perform a resistance exercise;

(d) detaching said resistance system from the individual;

(e) configuring said exercise equipment in said secondary configuration;

(f) attaching said acceleration system to the individual for the individual to perform an acceleration exercise;

(g) detaching said acceleration system from the individual;

(h) configuring said exercise equipment in said tertiary configuration; and, (i) mounting said belt on the individual to perform an exercise selected from one of a group consisting of a resistance exercise and an acceleration exercise.

* * * * *